United States Patent [19]

Frangiskos

[11] 3,936,372

[45] Feb. 3, 1976

[54] METHOD FOR BENEFICIATION OF MAGNESITE ORE

[75] Inventor: Anthony Z. Frangiskos, Athens, Greece

[73] Assignee: Financial Mining-Industrial and Shipping Corporation, Greece

[22] Filed: Dec. 10, 1974

[21] Appl. No.: 531,446

Related U.S. Application Data

[63] Continuation of Ser. No. 307,521, Nov. 17, 1972, abandoned.

[30] Foreign Application Priority Data

Nov. 24, 1971 Greece ..... 44504

[52] U.S. Cl. ..... 209/3; 209/8; 209/214; 209/11

[51] Int. Cl.[2] ..... B03B 1/02

[58] Field of Search ..... 209/8, 4, 11, 138, 100 AT, 209/3, 214; 423/177; 241/1

[56] References Cited

UNITED STATES PATENTS

| | | | |
|---|---|---|---|
| 1,248,880 | 12/1917 | McLaughlin | 423/177 X |
| 1,266,730 | 5/1918 | Webster | 209/4 X |
| 1,269,170 | 6/1918 | Faulkner | 209/11 X |
| 1,546,854 | 7/1925 | Miller | 209/11 X |
| 1,901,102 | 3/1933 | Holt | 209/8 X |
| 2,349,556 | 5/1944 | Kleckner | 423/156 X |
| 2,586,545 | 2/1952 | LeBaron | 209/11 X |
| 2,881,048 | 4/1959 | Bieneck | 241/1 X |
| 3,482,938 | 12/1969 | Oaska | 423/177 X |

FOREIGN PATENTS OR APPLICATIONS

| | | | |
|---|---|---|---|
| 274,889 | 4/1928 | United Kingdom | 209/8 |
| 1,110 | 1/1908 | United Kingdom | 209/11 |
| 1,322,140 | 2/1963 | France | 209/138 |

*Primary Examiner*—Robert Halper
*Attorney, Agent, or Firm*—Watson, Cole, Grindle & Watson

[57] ABSTRACT

A method for beneficiation of magnesite ore wherein the ore is subjected to calcination to decrease the bulk density of the magnesite relative to the gangue. Accordingly, after such calcination, conventional gravimetric separations can be conducted with greatly increased efficiency. When the calcination is conducted in a reducing atmosphere, initially non-magnetic gangue material is converted to a magnetic form and conventional magnetic separation procedures are conducted with enhanced efficiency.

13 Claims, 2 Drawing Figures

ANALYSES ARE GIVEN IN WT. %

METHOD FOR BENEFICIATION OF MAGNESITE ORE

This is a continuation of application Ser. No. 307,521 now abandoned filed Nov. 17th, 1972.

BACKGROUND OF THE INVENTION

1. Field of the Invention

The present invention is related to the beneficiation of ores and is particularly related to beneficiation of magnesite ores by gravimetric or magnetic procedures.

2. Description of the Prior Art

Run-of-mine magnesite ores usually contain gangue material such as serpentines, dunites, pegmatites, silica, etc. Both the serpentines and dunites normally contain a small percentage of iron, which thereby enables a portion of the gangue to be separated out by a magnetic separation process. Generally, such ores are amenable to gravimetric methods of separation due to the difference in the specific gravities of the pure magnesite (Sp.Gr. ≃ 2.70 to 2.80 g/cm$^3$) and the gangue (Sp.Gr. ranging from about 2.55 to about 2.65 g/cm$^3$), and the most commonly used method of separation is the dense media process. Such ores are also amenable to concentration by flotation, but this is an expensive method, since it first requires grinding the ore to a fine mesh, and subsequently requires expensive methods for briqueting the ground concentrate to facilitate the firing thereof to produce a dead-burned magnesite.

Some ores are not amenable to gravimetric separation in any event because the magnesite contained therein is porous and has an apparent specific gravity (bulk density) which is very nearly the same as the gangue. These latter described ores are of course amenable to concentration by flotation, but as mentioned before, this procedure is generally very expensive.

SUMMARY OF THE INVENTION

The primary object of the present invention is to provide a method for beneficiation of magnesite ores wherein the efficiency of the process is enhanced. In accordance with the invention, the efficiency of the beneficiation process is enhanced (1) by increasing the difference between the specific gravities of the magnesite and the gangue, (2) by causing the gangue to become magnetic, or (3) by a combination of these factors.

In its broader aspects, the invention includes calcining a magnesite ore whereby magnesium carbonate is decomposed to form magnesium oxide and the latter, being lighter in weight than magnesium carbonate, is more readily separated from the gangue which remains substantially unchanged in weight during calcination.

More specifically, the method of the invention comprises a process for recovering magnesite from its ores as a caustic-calcined magnesite wherein the ore is calcined at a temperature of from about 500°C to about 1000°C to convert the magnesite in the ore into a caustic-calcined magnesite and thereafter the latter is separated from the gangue by gravimetric separation.

If the calcination is conducted in a reducing atmosphere, gangue is transformed into a magnetic material which can be separated from either magnesium carbonate or magnesium oxide by a magnetic separation process. In this latter regard, the invention encompasses a process for recovering magnesite from its ores as caustic-calcined magnesite comprising the steps of calcining the ore at a temperature of from about 500°C to about 1000°C in a reducing atmosphere to convert magnesite in the ore into a caustic-calcined magnesite and to transform the gangue magnesite from the reduced gangue by magnetic separation; and separating caustic-calcined magnesite from gangue by a gravimetric procedure.

DESCRIPTION OF THE PREFERRED EMBODIMENTS

Figure 1:
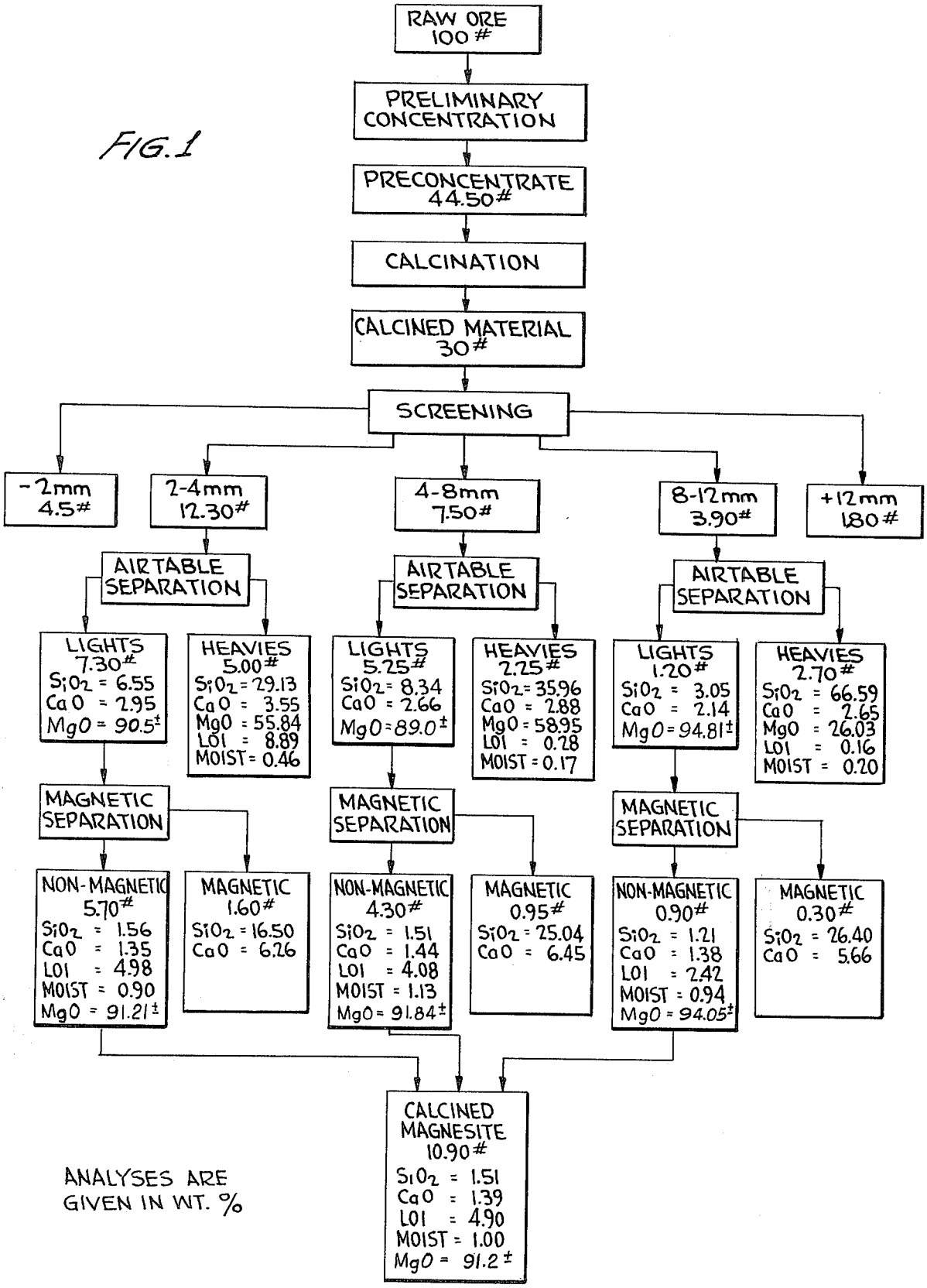
FIG. 1 is a schematic flowsheet diagram illustrating an ore beneficiating process which embodies the principles and concepts of the present invention.

In its broader aspects, the preferred method of the invention comprises calcining a magnesite ore at a temperature sufficient to cause a partial or full caustic-calcination of the magnesite contained therein. Such calcination can usually be carried out at a temperature above about 500°C and preferably between about 600°C and 1000°C. During such treatment, the magnesite will lose up to about 50% of its weight as a result of its decomposition in accordance with the reaction: $MgCO_3 \longrightarrow MgO + CO_2$.

Calcination of the ore does not cause a great loss of weight in the gangue material, and thus, the bulk density of the calcined magnesite becomes much lower than the bulk density of the calcined gangue material. Separation of the two can thereafter be easily accomplished by the use of conventional gravimetric methods. Dry gravimetric separation is preferable to wet gravimetric separation since wetting of the caustic-calcined material increases its bulk density making the separation more difficult. Dry separation on a pneumatic table is usually very successful, although a wet separation using a jig or a dense media in a cyclone has also sometimes provided acceptable results.

If necessary, one or more additional gravimetric separations can be performed on the light and heavy fractions of the first separation in order to improve the quality of the concentrate and increase the yield. Additionally, other types of separation (i.e., magnetic) can be performed to upgrade the light material or to improve recovery of the heavy material.

Prior to the calcination stage, the ore may be subjected to a preliminary mechanical preparation procedure including steps such as crushing, washing, screening, etc., and/or to a preconcentration procedure including steps such as hand or electronic sorting, magnetic separation, gravimetric separation, etc. The following specific example illustrates the specific aspects of the method of the invention:

EXAMPLE NO. 1

The method of the invention has been applied in the beneficiation of several types of ores with very good results. This example presents the results of one such application of the method which was conducted in accordance with the flowsheet of FIG. 1. One hundred pounds of magnesite ore was first subjected to a preliminary mechanical preparation which included crushing, washing and screening. This was followed by a preliminary concentration step, wherein part of the gangue material was removed by handsorting. Final sorting was accomplished using an optical separator (SORTEX machine) of a type well known to thos skilled in this art. 44.5 pounds of pre-concentrate having a size between about 2 and about 17 mm was obtained. This material was calcined in a rotary furnace at a temperature in the range of from about 850°C to about 1000°C. This heat treatment produced 30 pounds of material including calcined magnesite having a bulk density in the range of from about 1.4 to about 1.6 g/cm$^3$, and calcined gangue having a bulk density in the range of from about 2.2 to about 2.4 g/cm$^3$. The calcined material was screened to produce five separate fractions having respective approximate sizes of: less than 2mm; 2 to 4mm; 4 to 8mm; 8 to 12mm; and larger than 12mm. The larger than 12mm fraction was very lean in calcined magnesite and was rejected. The less than 2mm fraction was quite rich in calcined magnesite which could be recovered on a Kelly type pneumatic table for fine particles. However, this fine fraction could create difficulties during the subsequent firing to produce dead-burned magnesite and therefore it was excluded from the total recovered magnesite. The 2 to 4, 4 to 8, and 8 to 12mm fractions were subjected to a treatment on a BERRY type M-100 pneumatic table.

Due to the big difference in bulk density between the calcined magnesite and the calcined gangue material, an excellent separation was obtained on the pneumatic table as can be seen from the analyses of the light and heavy materials shown in FIG. 1. In order to upgrade the light materials separated from each fraction, a magnetic separation was performed on each of them. This separation produced a final concentrate comprising 10.90 pounds of calcined magnesite having the following impurity analysis: 1.51 wt% $SiO_2$; 1.39 wt% CaO; 4.90 wt% LOI and 1.00 wt% Moisture. This recovery of 10.90 pounds of caustic magnesite from the original run-of-mine ore corresponds very nearly to a 90% recovery of the magnesite originally contained in the ore.

In another aspect the invention includes a method comprising calcining of the ore in a reducing atmosphere. Such a calcination may usually be conducted at a temperature in the range of from about 500°C to about 1000°C. This treatment will cause the transformation of a big percentage of the initially non-magnetic or only slightly magnetic gangue material into a strongly magnetic material which is more readily separatable from the magnesite. Of course the magnesite will also lose part of its weight during the calcination due to its decomposition according to the reaction $MgCO_3 \rightarrow MgO + CO_2$ while the gangue material does not correspondingly suffer a great loss of weight.

The reduced ore is amenable to a magnetic separation process wherein all the gangue material that has been transformed into magnetic material is easily removed. This method is particularly applicable to ores in which most of the gangue material can be transformed into magnetic material as the result of being calcined in a reducing atmosphere. If the magnetic separation is not completely satisfactory due to the presence of gangue material that remains unaffected by the reduction, a gravimetric separation can be performed as described above.

Prior to the calcination step, the ore may be subjected to a preliminary mechanical preparation procedure including steps such as crushing, washing, screening etc., and/or a preconcentration procedure including steps such as hand or electronic sorting, magnetic separation, gravimetric separation etc.

The following specific example illustrates this aspect of the invention:

EXAMPLE NO. 2

Figure 2:
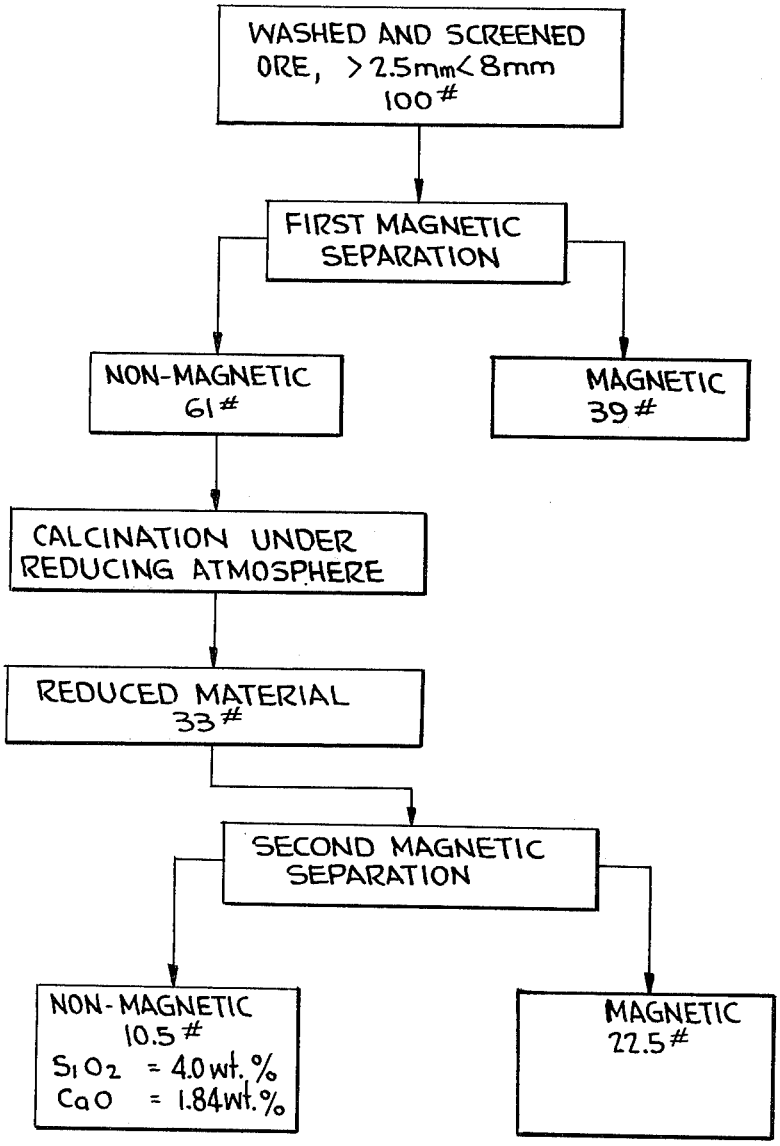
FIG. 2 is a schematic flowsheet diagram illustrating another ore beneficiating process which embodies the principles and concepts of the invention.

The foregoing method has been used to beneficiate magnesite ores with good results. Presented below are the results of such a use which was conducted in accordance with the flowsheet of FIG. 2. Magnesite ore was first crushed, washed and screened to present a fraction wherein the bulk of the particles had a size greater than about 2.5mm and smaller than about 8mm. One hundred pounds of this fraction was then dried and subjected to a first magnetic separation. Sixty-one pounds of nonmagnetic material from the first separation was then subjected to calcination in a rotary furnace in a reducing atmosphere comprising producers gas at a temperature of about 700°C. This calcination produced 33 pounds of reduced material which was then subjected to a second magnetic separation, to present 10.5 pounds of a final concentrate which includes 4.00 wt% $SiO_2$ and 1.84 wt% CaO.

I claim:

1. A process for recovering magnesite from its ores as a caustic-calcined magnesite comprising the steps of:

calcining a particulate magnesite ore having a particle size between about 2 and about 17mm by gradually heating the ore at a temperature of from about 500°C to about 1000°C so as to gradually raise the temperature of the ore for the desired calcination thereby converting the ore into a mixture of caustic-calcined magnesite having a bulk density in range of from about 1.4 to about 1.6 g/cm$^3$ and calcined gangue having a bulk density in the range of from about 2.2 to about 2.4 g/cm$^3$;

subsequently separating said caustic-calcined magnesite from said calcined gangue by a physical separation process by utilizing the difference between said bulk density of the caustic-calcined magnesite and said bulk density of the calcined gangue; and effecting said separation on said mixture without size reduction of the latter.

2. A process as set forth in claim 1 wherein the ore is subjected to a preconcentration step prior to said calcining.

3. A process for recovering magnesite from its ores as set forth in claim 1 wherein said physical separation is carried out pneumatically.

4. A process for recovering magnesite from its ores as set forth in claim 3 wherein said calcining is conducted in a reducing atmosphere to transform the gangue into a material having magnetic properties, and said process further including the step of separating calcined magnesite from the reduced gangue by magnetic separation.

5. A process as set forth in claim 1 further comprising the step of screening the mixture of material subsequent to said step of calcining and prior to said step of physical separation so as to separate the particles of the mixture into separate groups according to size.

6. A process for recovering magnesite from its ores as set forth in claim 1 wherein said physical separation process is a wet gravimetric separation process.

7. A process for recovering magnesite from its ores as set forth in claim 1 wherein said physical separation process is a dry gravimetric separation process.

8. A process for recovering magnesite from its ores as set forth in claim 1 wherein said calcining is conducted in a reducing atmosphere to transform the gangue into a material having magnetic properties, said process including the step of separating calcined magnesite from the reduced gangue by magnetic separation.

9. A process as set forth in claim 8 wherein the ore is subjected to a mechanical preparation step prior to said calcining.

10. A process as set forth in claim 4 wherein the ore is subjected to a preconcentration step prior to said calcining.

11. A process as set forth in claim 8 wherein the ore is subjected to a preconcentration step prior to said calcining.

12. A process as set forth in claim 1 wherein the ore is subjected to a mechanical preparation step prior to said calcining.

13. A process as set forth in claim 12 where in the ore is subjected to a preconcentration step prior to said calcining.

* * * * *